US005531919A

United States Patent [19]

Russo et al.

[11] Patent Number: 5,531,919

[45] Date of Patent: Jul. 2, 1996

[54] WALLPAPER STRIPPER

[75] Inventors: Gerald M. Russo, Oak Park; Kardar M. Majeed, Elk Grove, both of Ill.; Merle L. Houck, Griffith, Ind.

[73] Assignee: Roman Adhesives, Inc., Calumet City, Ill.

[21] Appl. No.: 410,836

[22] Filed: Mar. 27, 1995

Related U.S. Application Data

[63] Continuation of Ser. No. 154,291, Nov. 18, 1993.

[51] Int. Cl.[6] ..... C11D 3/386; B08B 1/00

[52] U.S. Cl. ..... 510/200; 510/393

[58] Field of Search ..... 252/174.12, DIG. 12, 252/170, 171; 134/4, 30, 42

[56] References Cited

U.S. PATENT DOCUMENTS

| | | | |
|---|---|---|---|
| 2,607,359 | 8/1952 | Oesting | 134/30 |
| 4,092,175 | 5/1978 | Martin et al. | 134/42 |
| 4,274,884 | 6/1981 | Cartwright | 134/4 |
| 4,305,837 | 12/1981 | Kaminsky et al. | 252/174.12 |
| 5,221,495 | 6/1985 | Cao | 252/135 |
| 5,234,832 | 5/1989 | Disch et al. | 435/264 |
| 5,269,960 | 12/1993 | Gray et al. | 252/174.17 |
| 5,286,404 | 2/1994 | Eriksen | 252/174.12 |

FOREIGN PATENT DOCUMENTS

| | | |
|---|---|---|
| 3247484 | 6/1986 | Germany . |
| 2058122 | 4/1981 | United Kingdom . |

*Primary Examiner*—Paul Lieberman
*Assistant Examiner*—Kery Fries
*Attorney, Agent, or Firm*—Marshall, O'Toole, Gerstein, Murray & Borun

[57] ABSTRACT

A wallpaper stripper includes a humectant and a bond degrading component. Optionally, the stripper can include one or more of a surfactant, a high boiling point solvent and a stabilizer. A method of using the humectant in a wallpaper stripper includes the steps of mixing the humectant and the bond degrading component together. When placed on a surface having wallpaper to be removed, the stripper remains moist for an extended time period to facilitate penetration of the bond degrading component and degradation of the bond.

9 Claims, No Drawings

WALLPAPER STRIPPER

CROSS REFERENCE TO RELATED APPLICATION

This application is a continuation of U.S. application Ser. No. 08/154,291, filed Nov. 18, 1993.

TECHNICAL FIELD

This invention generally relates to a stripper for removing wallpaper from a surface. More particularly, the invention relates to a wallpaper stripper including a humectant capable of extending the time period during which the stripper is moist and effective.

BACKGROUND OF THE INVENTION

Wallpaper is held to a surface, e.g. a wall, using a paste that can be based on a polycarbohydrate, e.g., starch or cellulose. The paste is applied to the wallpaper and forms a bond between the wallpaper and the surface.

To remove the wallpaper, the bond must be degraded without harming the underlying surface as by removing part of the surface or leaving wallpaper thereon. It is desirable to remove the wallpaper with as little force, such as existed using a scraper, as possible to avoid damaging the underlying surface.

Steam generating devices are known to assist in removal. The steam typically only rehydrates the paste. If the person removing the wallpaper permits the rehydrated paste to dry too much before attempting to remove the wallpaper, the paste can rebond the wallpaper to the wall making removal more difficult. Care must be taken so that the steam does not harm the underlying surfaces. Steam is also messy and expensive.

Liquid wallpaper strippers are known for removing wallpaper using an active ingredient that acts on the bond. Wallpaper having a liquid impermeable layer, such as vinyl wallpaper, must be scored or perforated to permit penetration of the liquid. The liquid helps maintain an environment in which the active ingredient is effective. Moisture can be lost due to evaporation of the liquid prior to the active ingredient penetrating the wallpaper and acting on the bond. Evaporation can change the environment to one in which the active ingredient is not effective. This rapid evaporation requires that the stripper be reapplied to the wallpaper to maintain the necessary moisture and environmental conditions. Some liquid strippers have a relatively low concentration of the active ingredient to maintain stability of the stripper. The low concentration requires the use of excessive amounts of the stripper in order to attain a concentration at the bond effective to act on the bond. The repeated application of the stripper to maintain the moisture and the environment or obtain the desired concentration is time consuming, expensive and can cause moisture-related damage to the underlying surface.

The active ingredient must come in contact with the bond to be effective. If the stripper does not facilitate penetration of the wallpaper by the active ingredient, then the time period required to remove the wallpaper may be excessive. The excessive time period can also permit more moisture loss requiring reapplication of the stripper which is costly.

A wallpaper stripper that overcomes at least one of the aforementioned shortcomings of existing wallpaper removal systems is highly desirable.

SUMMARY OF THE INVENTION

The invention provides a wallpaper stripper that maintains its moisture during use for an extended time period to enhance the removal of the wallpaper. The stripper is stable even at a high concentration of a component for degrading the bond. The ability of the stripper to maintain moisture, which contributes to the maintaining a desirable environment, and to be stable at a high concentration permits the stripper to be effective without requiring multiple applications to maintain moisture or increase the concentration.

The wallpaper stripper contains a humectant and the bond degrading component, which preferably is an enzyme. The humectant contributes to maintaining moisture and hence an environment under which the bond degrading component is effective. The stripper can also contain a surfactant, a high boiling point solvent and stabilizers. The surfactant assists the penetration of the moisture and enzyme into the wallpaper and bond to facilitate degradation of the bond and hence removal of the wallpaper. The solvent is presently theorized to contribute to moisture retention. The stabilizers are presently theorized to permit the use of the relatively high concentration of enzyme while maintaining good shelf life.

The invention is also to a method of using a humectant in a wallpaper stripper that includes the steps of combining the humectant and the component for degrading the bond and mixing the combination. The method can also include the step of applying the stripper to a surface having wallpaper thereon.

Numerous other advantages and features of the present invention will become readily apparent from the following detailed description of the preferred embodiments and the appended claims.

DETAILED DESCRIPTION OF THE PREFERRED EMBODIMENTS

Although this invention is susceptible to embodiment in many different forms, there are described in detail herein, presently preferred embodiments of the invention. It should be understood, however, that the present disclosure is to be considered as an exemplification of the principles of this invention and is not intended to limit the invention to the embodiments described.

A wallpaper stripper including a humectant and a component for degrading a bond between a surface and wallpaper is disclosed. The humectant is capable of extending the time period during which the stripper is moist which facilitates removal of the wallpaper. The stripper can also include at least one of a surfactant, a high boiling point solvent and stabilizer. The stripper remains moist while on the wall for an extended time period, has a relatively high concentration of bond degrading component and, when the surfactant is present, exhibits improved penetration of the bond degrading component into the bond.

The humectant is selected to provide improved moisture retention which permits the stripper to remain moist for a longer time period. Retaining moisture is important to continued penetration of the bond degrading component and maintaining an environment in which the bond degrading component is effective.

Representative of the humectant are polyalkylene glycols wherein the alkylene group has about two to about six carbon atoms. Preferably, the number average molecular weight of the glycol is in the range of about 300 to about 1500 daltons. Representative glycols include polyethylene glycol, ethylene glycol, propylene glycol, butylene glycol and the like. A most preferred humectant is a polyethylene glycol that preferably has a number average molecular weight of about 600 daltons.

The bond degrading component is capable of breaking the bond formed by the paste. Typically, the paste is based on a polycarbohydrate, e.g.,starch or cellulose. Preferably, this breaking of the bond is accomplished by permanently breaking the molecules that form the bond so that the bond cannot reform. A preferred bond degrading component is an enzyme. A preferred enzyme, for a starch based paste, is amylase, which has the chemical name 1,4-alpha-D-glucan glucanohydrolase. Tenase is an amylase that is commercially available from Solvay Enzymes, Inc., Elkhart, Ind. An enzyme for a cellulose based paste is a cellulase. The enzyme activity of the stripper is preferably at least about 30,000, more preferably about 35,000 to about 60,000, mohlgewuth units per gram (mwu/gm) as determined by Solvey procedure 400.03.

When the bond degrading component is an enzyme, the pH is selected to be compatible with that enzyme. A typical pH for the stripper is in the range of about 6 to about 7.

The stripper can also include a surfactant to help lower the surface tension which assists the penetration of the bond degrading component through the wallpaper and into the bond. The preferred surfactants have a nonyl-phenol hydrophobic base, a hydrophile-lipophile balance (HLB) in the range of about 10 to about 15 and are water soluble. A preferred surfactant is T-DET-M-9.5 (9.5 mole ethoxylate of nonylphenol) commercially available from Coleman Chemical, and compensable surfactants are available from Union Carbide, Rohm and Haas Co., and other companies.

The stripper can also include a solvent that preferably is a high boiling point solvent, i.e., a solvent that has a high boiling temperature. Representative high boiling point solvents include alkylene glycol alkyl ethers wherein the alkylene group contains about two to about four carbon atoms, preferably three carbon atoms, and the alkyl group contains one to about five carbon atoms, preferably one to about three carbon atoms. Representative high boiling point solvents include mono- and di- ethylene glycol methyl ether, mono- and di- propylene glycol methyl ether, mono- and di- ethylene glycol butyl ether, mono- and di- propylene glycol ethyl ether and the like. A most preferred solvent is monopropylene glycol methyl ether.

The stripper can also include a stabilizer to improve the shelf life, especially at high enzyme concentrations. Representative stabilizers include soluble calcium salts that are compatible and do not precipitate out (e.g., calcium chloride, calcium ascorbate, calcium nitrate, calcium carbonate and the like) and pH buffers such as phosphoric acid salts. Preferably, the stripper has a calcium ion content in the range of about 200 to about 400 parts per million (ppm).

The stripper can also include preservatives (e.g., bactericides and fungicides) and fragrance.

The stripper is preferably an aqueous stripper having water as the main solvent.

The weight ratio of humectant to the bond degrading component is preferably in the range of about 1:0.5 to 1:2. The weight ratio of the surfactant to humectant is preferably in the range of about 1:2 to about 1:8. The weight ratio of stabilizer to bond degrading component is preferably about 1:10 to about 1:20.

The stripper most preferably contains the humectant in an amount in the range of about 15 to about 30 weight percent (wt %), the bond degrading component in an amount in the range of about 20 to about 40 wt %, the surfactant in an amount in the range of about 5 to about 15 wt % and the high boiling point solvent in an amount in the range of about 30 to about 50 wt %; the weight percents being based upon the total amount of humectant, bond degrading component, surfactant and high boiling point solvent present in the stripper.

Production of the stripper can be accomplished by mixing the components at room temperature. When the bond degrading component is an enzyme, it is preferred to add the enzyme last after the pH has been adjusted into the desired range.

The invention is also to a method of using a humectant to enhance the action of a stripper that includes the steps of combining the humectant with the bond degrading component and mixing the combination. The method can also include the step of applying the mixture to a surface having wallpaper bonded thereto.

The stripper is used by applying it to a surface having wallpaper to be removed. If the wallpaper has a liquid impermeable layer, such as a vinyl wallpaper, the layer is scored or perforated to permit penetration.

The following example is given by way of illustration and not limitation.

EXAMPLE

WALLPAPER STRIPPER

A wallpaper stripper of the present invention was prepared using the components identified in the TABLE.

TABLE

WALLPAPER STRIPPER

| COMPONENT | WEIGHT (lbs) |
|---|---|
| Water | 33,238 |
| Calcium Chloride (32%) | 91 |
| Dowanol PM[1] | 1,950 |
| T-DET N-9.5[2] | 390 |
| PEG 600[3] | 1,950 |
| Amerstat 252[4] | 20 |
| Fragrance[5] | 20 |
| En-Phos 50[6] | 1.56 |
| Tenase L-1,200[7] | 1,467 |

[1]Dowanol PM, propylene glycol methyl ether commercially available from Dow Chemical Co.
[2]T-DET N-9.5, ethoxylate of nonylphenol, commercially available from Thompson-Hayward Chemical Co.
[3]PEG 600, polyethylene glycol 600, commercially available from Dow Chemical Co.
[4]Amerstat 252, 5-chloro-2 methyl-4isothiazolin-3-one and 2-methyl-4isothiazolin-3-one, commercially available from Drew Chemical Co.
[5]Fragrance, Lemon 1285, commercially available from Petro Products Co.
[6]En-Phos 50, phosphoric acid salt, commercially available from FMC Industries, Rolling Meadows, Illinois.
[7]Tenase L-1,200, 1,4-alpha-D-glucan glucanohydrolase, having an enzyme activity of about 1,200,000 mwu/gm, commercially available from Solvay Enzymes, Inc.

To manufacture the stripper, the water and the calcium chloride were mixed for at least five minutes prior to adding the remaining components except for the Tenase. After ten minutes of mixing, the pH was tested and adjusted until it was in the range of about 6 to about 7. Then, the Tenase was added with mixing.

The stripper of the present invention remains moist for an extended time period which permits the bond degrading component to penetrate the wallpaper and the bond in order to facilitate degrading the bond. The relatively high concentration of the bond degrading component permits the stripper to act upon the bond without additional application of the stripper to achieve an amount of bond degrading component effective to degrade the bond.

It is presently theorized that the above-described advantages are achieved because of the unique combination of components in the stripper and that the components make the contributions described hereinbelow. The humectant helps maintain the stripper in a moist condition so that the bond degrading component can penetrate the paper and bond and then effect degradation. Moisture retention can help maintain an environment wherein the bond degrading component is effective. The surfactant facilitates penetration of the bond degrading component by reducing the surface tension between the stripper and the wallpaper and bond. The high boiling point solvent helps maintain the stripper in a moist condition by not readily evaporating and drawing moisture with it. The stabilizers result in a stable stripper even at high concentrations of bond degrading component which contributes to the effectiveness of the stripper.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

We claim:

1. An aqueous stripper for removing wallpaper that is bonded to a surface, the stripper comprising:

water;

an enzyme selected from the group consisting of amylase and cellulase for degrading the bond in an amount of about 20% to about 40% by weight;

an enzyme stabilizer;

a polyalkylene glycol humectant, wherein the alkylene group has about 2 to about 6 carbon atoms in an amount of about 5% to about 15% by weight, wherein the weight ratio of humectant to enzyme is in the range of about 1:0.5 to 1:2;

a surfactant in an amount of about 5% to about 15% by weight, wherein the weight ratio of surfactant to humectant is in the range of about 1:2 to about 1:8;

an alkylene glycol alkyl ether solvent in an amount of about 30% to about 50% by weight; and wherein percentages are based on the weight of enzyme, humectant, surfactant and alkylene glycol alkyl ether solvent.

2. An aqueous stripper for removing wallpaper that is bonded to a surface, the stripper consisting essentially of:

water;

an enzyme selected from the group consisting of amylase and cellulase for degrading the bond in an amount of about 20% to about 40% by weight;

an enzyme stabilizer;

a polyalkylene glycol humectant, wherein the alkylene group has about 2 to about 6 carbon atoms in an amount of about 5% to about 15% by weight, wherein the weight ratio of humectant to enzyme is in the range of about 1:0.5 to 1:2;

a surfactant in an amount of about 5% to about 15% by weight, wherein the weight ratio of surfactant to humectant is in the range of about 1:2 to about 1:8;

an alkylene glycol alkyl ether solvent in an amount of about 30% to about 50% by weight; and wherein percentages are based on the weight of enzyme, humectant, surfactant and alkylene glycol alkyl ether solvent.

3. The stripper of claim 2, wherein the pH is in the range of about 6 to about 7.

4. The stripper of claim 2, wherein the alkylene glycol alkyl ether solvent has 2 to 4 carbon atoms in the alkylene portion of the solvent, and 1 to 5 carbon atoms in the alkyl portion of the solvent.

5. The stripper of claim 2, wherein the enzyme has an enzyme activity of at least about 30,000 mohlgewuth units per gram.

6. The stripper of claim 5, wherein the bond degrading means is only one of amylase and cellulase.

7. The stripper of claim 2, wherein the polyalkylene glycol humectant has a number average molecular weight in the range of about 300 to about 1500.

8. A method of removing wallpaper from a surface having the wallpaper bonded thereto, the method comprising the steps of:

applying the stripper of claim 2 to the wallpaper; and then removing the wallpaper to which the stripper was applied.

9. A method of removing wallpaper from a wall comprising applying to an outer surface of the wallpaper the composition of claim 2, and after a soaking period sufficient to loosen the wallpaper, separating the wallpaper from the wall.

* * * * *